US005098074A

United States Patent [19]

Mandel et al.

[11] Patent Number: 5,098,074

[45] Date of Patent: Mar. 24, 1992

[54] FINISHING APPARATUS

[75] Inventors: Barry P. Mandel; William R. Burger, both of Fairport; Richard A. Van Dongen, Newark, all of N.Y.

[73] Assignee: Xerox Corporation, Stamford, Conn.

[21] Appl. No.: 647,333

[22] Filed: Jan. 25, 1991

[51] Int. Cl.[5] ..... B42B 2/00

[52] U.S. Cl. ..... 270/53

[58] Field of Search ..... 270/37, 53, 58

[56] References Cited

U.S. PATENT DOCUMENTS

| | | | |
|---|---|---|---|
| 4,424,963 | 1/1984 | Bartholet et al. | 270/53 |
| 4,469,320 | 9/1984 | Wenthe, Jr. | 271/98 |
| 4,497,478 | 2/1985 | Reschenhofer et al. | 270/53 |
| 4,558,942 | 12/1985 | Chiama | 270/53 |
| 4,605,211 | 8/1986 | Sonobe | 270/53 |
| 4,782,363 | 11/1988 | Britt et al. | 355/15 SH |
| 4,871,158 | 10/1989 | May et al. | 270/53 |
| 4,925,172 | 5/1990 | Christy et al. | 270/53 |
| 4,964,154 | 8/1990 | Nakamura | 270/53 |

FOREIGN PATENT DOCUMENTS

| | | | |
|---|---|---|---|
| 0346851 | 12/1989 | European Pat. Off. . | |
| 423758A2 | 4/1991 | European Pat. Off. . | |
| 267661 | 11/1988 | Japan | 270/58 |

OTHER PUBLICATIONS

Excerpts from Operators Manual of Auto Stapler II Manufactured by Canon.

*Primary Examiner*—Edward K. Look
*Assistant Examiner*—Therese M. Newholm

[57] ABSTRACT

A finishing apparatus adapted to receive and fasten collated sets of copy sheets is provided. The finishing apparatus includes a stacking tray in which successive sets of fastened copy sheets can be stacked. The copy sheets are compiled on a movable compiling member, a portion of which is positioned selectively over the stacking tray. A paper path is used to transport the copy sheets to both the stacking tray and the movable compiling member so as to position one portion of each copy sheet in the stacking tray with the remaining portion of each copy sheet being located in the movable compiling member. A fastener, such as a stapler is positioned adjacent to the movable compiling member. A retracting mechanism is employed to move the portion of the movable compiling member supporting the copy sheets away from both the copy sheets and the stacking tray after the copy sheets of the set of copy sheets have been fastened to one another so that the entire set of fastened copy sheets is supported in the stacking tray.

42 Claims, 9 Drawing Sheets

FINISHING APPARATUS

BACKGROUND OF THE INVENTION

1. Field of the Invention

The present invention relates to a finishing apparatus for a printing apparatus, and more particularly to an arrangement that partially integrates the structural and functional aspects of a stacking tray and a retractable compiling shelf to provide a compact finishing apparatus.

2. Description of Related Art

The present invention is particularly suitable for receiving and fastening collated sets of copy sheets; that is, the invention is particularly suitable for, but not limited to, precollation copying, i.e., automatically plurally recirculated document set copying provided by a physical or electronic recirculating document handling system or "RDH", although the invention is also compatible with nonprecollation or post collation copying. Precollation, collation, recirculative, or RDH copying, as it is variably called, is a known desirable feature for a copier or printer. It provides a number of important known advantages. In such precollation copying any desired number of collated copy sets or books may be made by making a corresponding number of recirculations of the set of documents in collated order past the copier imaging station and copying each document page (normally only once) each time it circulates through the imaging station. The copies therefrom may exit automatically the copier processor in proper order for stacking as precollated sets, and thus do not normally require subsequent separation and collation in a sorter or collator. On-line finishing (stapling or stitching and/or gluing or other binding) and/or removal and stacking and offsetting of completed but unfinished copy sets may thus be provided while further collated copy sets are being made in further circulations of the same document set.

Examples of prior automatic on-line collating copier finishers (staplers, stitchers, gluers or other binders) and/or offsetters and their controls are referenced in U.S. Pat. No. 4,782,363 to Britt et al., the disclosure of which is incorporated herein by reference.

A discussion of references that appear pertinent to the present invention follows:

U.S. Pat. No. 4,497,478 discloses an apparatus including a housing to be positioned adjacent a copy machine to receive copies from the machine. The apparatus squares the copies, staples them together and finally stacks them.

U.S. Pat. No. 4,605,211 discloses a sheet processing device adapted to be mounted to the sheet output portion of an image-forming apparatus. The device receives output sheets, automatically aligns them to one another, and then binds them in a bundle.

U.S. Pat. No. 4,871,158 discloses a finishing apparatus for binding copy sheets received in succession at a sheet compilation station. The compilation station is defined by a movable, horizontally arranged plate upon which sheets are collected, as well as stapling heads for two or more stapling apparatus. When the last sheet of a set to be stapled is collected, the plate is quickly retracted from the set in timed sequence with the clamping of the stapling heads. Subsequently the set is dropped onto a vertically movable tray.

The above-discussed patents describe techniques for compiling sheets in a first location, and then ejecting the completed set therefrom to a separate, second set stacking location. The employment of two separate locations tends to unduly increase the size and cost of these prior art finishers. For example, in the arrangement disclosed by U.S. Pat. No. 4,871,158, the compiling tray must be retracted a distance equaling at least the width or length of the stapled set of copy sheets. Accordingly, a substantial space must be allotted in the printing apparatus to accommodate the compiling tray when it is disposed in the retracted position.

In contrast to the above-discussed patents, U.S. Pat. No. 4,424,963 discloses a compact single-tray finisher. In the arrangement disclosed by U.S. Pat. No. 4,424,963, copy sheets are directed to an accumulation device and stapling mechanism by way of a vacuum transport device. The accumulation device and stapling mechanism are disposed adjacent to a stacking/compiling tray, so that sheets clamped into the accumulation device have portions that are (apparently) draped onto an output tray. In operation, the copy sheets are transported to and securely clamped into the accumulation device until a predetermined number of sheets is accumulated therein. Once the predetermined number is achieved, a staple is driven through the stack, and the stack is released from the accumulation device and stapling mechanism, so that it falls onto the output tray.

Even though the concept underlying the design of U.S. Pat. No. 4,424,963 may be superior to the concepts underlying the designs of the above-discussed patents, the design of U.S. Pat. No. 4,424,963 is not optimum. For example, the mechanism used to feed leading edges of the copy sheets into the accumulation device and stapling mechanism, namely the vacuum transport device, would be expensive. Moreover, since the trailing edges of the collected sheets rest on the output tray or the completed stack(s), a substantial portion of the stack being compiled droops. Consequently the sheets being compiled would have a natural tendency to pull away from the accumulation device and out of registration.

Other important examples of references that disclose finishers using at least a portion of one tray to both compile and stack completed sets of copy sheets include a European Patent Application having the Publication No. 346,851 A1, and an operator's manual for the AutoStapler II—the AutoStapler II being a finisher used in Canon Copiers NP4835, NP6650, and NP8580. The finisher of the European Patent Application includes an accommodation tray, i.e. a stacking tray, positioned adjacent to a fixed stacking portion, i.e. a compiling shelf, the compiling shelf having front and rearward portions. A vertical abutment plate (end stop) is movably disposed on the fixed compiling shelf, while rollers, through which copy sheets are ejected, are positioned intermediate of the front and rearward portions of the compiling shelf. A stapler is positioned near the rearward portion of the compiling shelf. The stacking tray is underlain by an elevator, while a positioning plate or tamper is positioned along a lateral edge of the stacking tray. In operation, the abutment plate is positioned on the rearward portion of the compiling shelf and copy sheets are ejected through the rollers such that a set of the sheets is collected in both the stacking tray and the compiling shelf. Edges of the sheets are aligned or registered by the tamper and the abutment plate. Once a set has been collected and registered, a staple is driven through a corner thereof, and the stapled set is ejected from the compiling shelf by use of the abutment plate, so that the set either rests on the surface of the stacking tray or another stapled set of copy sheets. The finisher of said European Patent Application represents an improvement over the finishers of the above-discussed patents in that it does not require that the entire width or length of the stapled set be ejected from the compiling shelf. Since stapled sets are ejected by moving the abutment plate across the entire length of the compiling shelf, however, ejection distance is not optimally minimized. Indeed, it is desirable to minimize ejection distance as much as possible to not only control the speed at which the finisher is capable of operating, but to insure that the stapled sets are not scattered as a result of being pushed an excessive distance.

Conceptually, the AutoStapler II is structurally similar to and operates in much the same way as the finisher of the European Patent Application. However, it uses a closing nip of ejection rollers for set ejection. Both of these finishers employ a mechanism for controlling stack height of stapled sets that collect on the stacking tray. The mechanism of the AutoStapler II includes a pivotable lever having a first end disposed in front of the compiling shelf and a second end in contact with a sensor disposed above the compiling shelf. In operation, the lever rests on the stacking tray or the stack of collected sets. Each time the stack changes, on account of a set being ejected from the compiling shelf, the lever is pivoted so that it contacts the sensor and moves the elevator, and hence the stacking tray, down by a predetermined distance.

While the stack height control mechanism of the AutoStapler II represents an advance in the art, it could pose problems to the unwary user. In particular, since the lever is disposed on top of the stack of stapled sets it must be pivoted each time the user removes the stack from the stacking tray. Inadvertently the unwary user could cause the sensor to be actuated, thus causing undesirable movement of the elevator. The exposed level could even be damaged by a careless operator. For a general discussion of stack sensors, reference is made to U.S. Pat. No. 4,469,320 and prior art cited therein.

In view of the discussion above, it would be desirable to provide a compact finishing apparatus that optimally minimizes ejection distance of stapled sets from a compiling shelf to a stacking tray. Moreover, it would be desirable if the height of the stacking tray could be varied by an elevator through use of a sensing mechanism that is disposed remotely with respect to the stacking tray and/or stapled sets of copy sheets deposited thereon.

SUMMARY OF THE INVENTION

In accordance with the invention there is provided a finishing apparatus that is adapted to receive and fasten collated sets of copy sheets. The finishing apparatus includes means for stacking successive sets of fastened copy sheets and a movable compiling member, the movable compiling member having a portion disposed selectively over the stacking means. In one example, the copy sheets are transported by way of a paper path to both the stacking means and the compiling member so as to position one portion of each copy sheet in the stacking means with the remaining portion of each copy sheet being located in the movable compiling member. Means for fastening a set of copy sheets are positioned adjacent the compiling member. Means are provided to retract the portion of the movable compiling member disposed over the stacking means after the copy sheets of the set of copy sheets have been fastened to one another so that the entire set of fastened copy sheets is supported in the stacking means.

In one aspect of the invention, the apparatus includes elevator means for either lowering or raising the stacking means to accommodate for changes in the height of the stack of sets collected in the stacking means. The elevator means can be used with stack height sensor means, the stack height sensor means being adapted to sense the height of the stapled sets on the stacking means or tray. The stack height sensor means may be mounted under the portion of the movable compiling member disposed selectively over the stacking tray, i.e. under a partial compiling shelf, and movable with the partial compiling shelf away from the stacking tray for protection by the partial compiling shelf.

Ejection of a stapled set may be facilitated by set ejecting means which push the stapled set off the partial compiling shelf towards the stacking tray by a short distance. Registration means can be used to align the remaining portions of the copy sheets being located in the compiling member along at least one edge thereof. In one example, the registration means includes scuffing means, which scuffing means urge coincidental corners of the copy sheets into a registration corner. The registration corner may be defined by an abutment tab and a sidewall. The abutment tab forms an integral part of and extends upwardly from a back edge of said compiling member. The sidewall is adjacent to and extends upwardly from a side edge of the compiling member.

Various advantages of the disclosed finishing apparatus will be appreciated by those skilled in the art. First, the distance required for each fastened set to be moved from the rear edge of the compiling shelf to the front edge of the compiling shelf, and to be stacked in the stacking tray, is minimized substantially since a front portion of the compiling shelf is superposed with the stacking tray during compiling but not during stacking. This allows faster retracting, and therefore decreases both set movement and set disturbance. Further, it allows a more compact (overall smaller) finisher. Second, the sensing means is protected while the fastened set is being ejected as well as when sets are being removed from the stacking tray since the sensing means moves with the compiling shelve. Finally, each set may be registered precisely by positioning superposed corners of copy sheets in the registration corner. Moreover, use of the scuffing means allows for the precise registration of copy sheets having mixed sizes.

These and other aspects of the invention will become apparent from the following description used to illustrate a preferred embodiment of the invention read in conjunction with the accompanying drawings.

While the present invention is described primarily in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DESCRIPTION OF THE PREFERRED EMBODIMENT

Figure 1A:
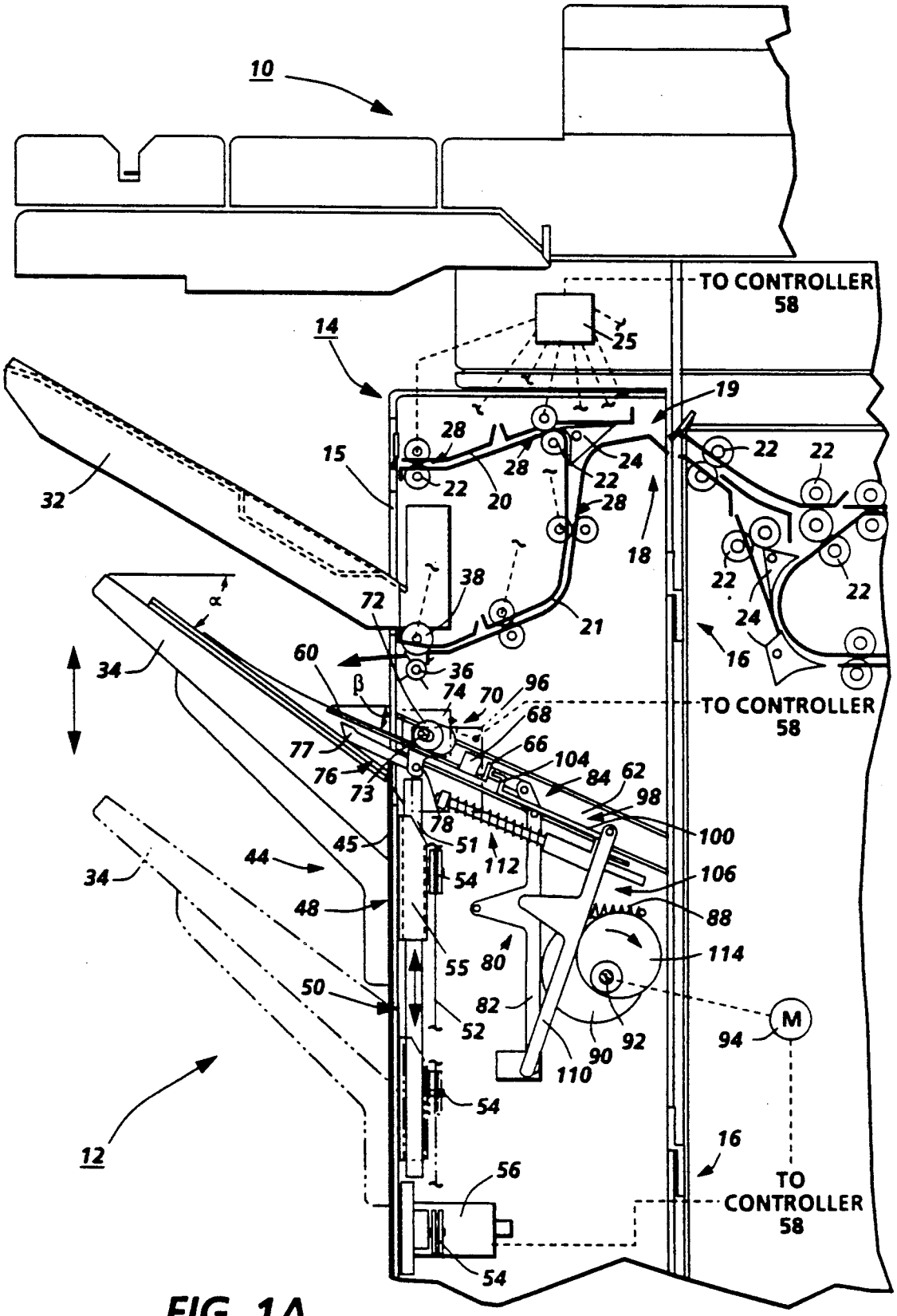
FIG. 1A is a schematic, fragmentary, elevational view of a single tray finishing apparatus with a stapler disposed adjacent to a movable compiling shelf, the finishing apparatus embodying the present invention.

For a general understanding of the features of the present invention, reference is made to the drawings. In the drawings, like reference numerals have been used throughout to designate identical elements. FIG. 1A depicts the output portion of an electrophotographic printing apparatus 10 incorporating a single tray finishing apparatus 12. It will become evident from the following discussion that the single tray finishing apparatus 12 is equally well suited for use in a wide variety of printing apparatus, and is not necessarily limited in its application to the particular machine 10 shown herein. The finishing apparatus 12 illustrated in FIG. 1A is shown as a modular unit 14 having a housing 15. The housing 15 is detachably mounted to the printing apparatus 10 by a conventional fastening arrangement 16. While the finishing apparatus 12 is mounted to the printing apparatus 10 by way of the housing 15, it is also contemplated that the finishing apparatus 12 could be constructed as an integral part of the printing apparatus 10.

The finishing apparatus 12 conventionally communicates with the printing apparatus 10 by way of a transporting or paper path network 18. Paper path network 18 includes paper paths 19–21 in which rollers 22 and deflectors 24 are disposed. The rollers 22 and the deflectors 24 are driven by a drive 25. Each pair of rollers 22 defines a nip 28 for transporting a copy sheet through the paper paths 19,20 or 19,21.

The paper paths 20 and 21 respectively feed upper stacking tray 32 and lower stacking tray 34. At the output of the paper path 20, the rollers 22 may be corrugated to facilitate ejection of copy sheets therefrom. At the output of paper path 21, a paddle wheel 36 is used, in conjunction with a corrugated roller 38, to drive each copy sheet therefrom at an appropriate velocity. Upper stacking tray 32, is mounted fixedly to the housing 15, while the lower stacking tray 34 is both supported by an elevator assembly 44 and connected operatively to a side shifting plate 45. While the upper stacking tray 32, is mounted fixedly to the housing 15, in other equally preferred embodiments, the side-shifting plate 45 could be connected operatively to the upper stacking tray 32. Each of the stacking trays 32, 34 is slanted or extends in a transverse direction relative to the horizontal, at an angle alpha, to facilitate the stacking of individual copy sheets or stapled sets of copy sheets.

The elevator assembly 44 includes an elevator support 48, the elevator support 48 being connected operatively to a track assembly 50. The track assembly 50 includes a track 51 and a cable 52 wrapped around a set of pulleys 54. A portion 55 of the elevator support 48 is slidably connected to the track, so that elevator support 48 can be raised and lowered in response to the movement of the cable 52. One of the pulleys 54 is driven by an elevator motor 56, the construction of which motor 56 is known. The operation of elevator motor 56, as well as the drive 25 mentioned above, is controlled programmably by a controller 58.

Some examples of control systems, such as the control system used to implement the controller 58, including sheet detecting switches, sensors, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general and preferable to program and execute control functions and logic, such as those executed by controller 58, with conventional software instructions for conventional microprocessors. This is taught by the above and other patents and various commercial copiers. Such software may, of course, vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hard-wired logic or switching systems. As shown in the above-cited art, the control of exemplary document and copy sheet handling systems in copiers may be accomplished by conventionally actuating them by signals from the copier controller directly or indirectly in response to simple programmed commands and from selected actuation or non-actuation of conventional copier switch inputs. The resultant controller signals may conventionally actuate various conventional electrical solenoids or the like in the copier in the selected steps or sequences as programmed.

Figure 2:
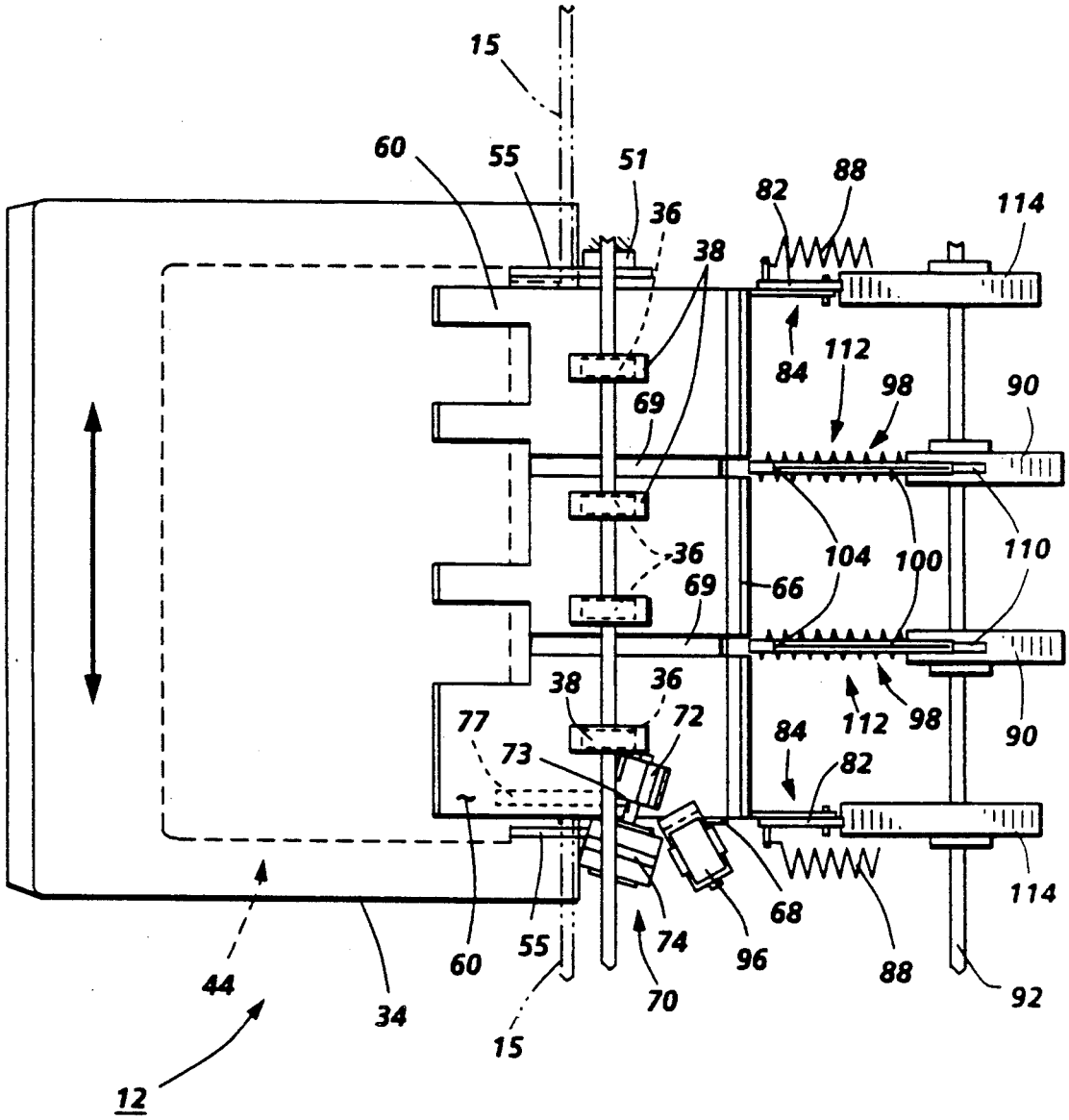
FIG. 2 is a plan, fragmentary view of the FIG. 1A finishing apparatus.

A movable compiling shelf 60 (FIG. 1A) is slidably mounted in a pair of support rails 62. The compiling shelf 60 is slanted or extends in a transverse direction relative to the horizontal, at an angle beta, to facilitate compiling of copy sheets on the compiling shelf 60. Preferably, for reasons discussed below, the magnitude of angle beta is less than the magnitude of angle alpha. The support rails 62 are mounted on opposite sides of the housing 15, and only one of the support rails 62 is shown in the cross-sectional view of FIG. 1A. The structural arrangement employed to couple side edges of the compiling shelf 60 to support rails 62 is known. Referring to FIG. 2, the compiling shelf 60 is typically a rectangular or square metal platform. Channels 70 are defined within compiling shelf 60 and are disposed in a direction parallel with copy sheet conveyance.

The compiling shelf 60 defines, or is operatively associated with, a registration arrangement (FIGS. 1A and 2) including one or more abutment tabs or plates 66 integrally formed with a back edge of the compiling shelf 60, and a side plate 68, the side plate 68 being immediately adjacent to a side edge of the compiling shelf 60. In the illustrated embodiment of FIG. 1A, the side plate 68 is connected to the compiling shelf 60, but in other embodiments, the side plate 68 could be integrally formed with a wall of the housing 15. One of the abutment tabs 66 and the side plate 68 form a registration corner, the significance of which corner will be discussed in further detail below.

The registration arrangement also includes a scuffing assembly 70. The scuffing assembly 70 includes a paddle or foam wheel 72 connected to a shaft 73. The wheel 72 is perpendicular to the surface of the compiling shelf 60 (FIG. 1A) and angled acutely (FIG. 2) relative to the plane defined by the side plate 68. The shaft 73 is connected to a motor 74, the motor 74 being capable of driving the wheel 72. The motor 74 is in communication with the controller 58. While in the present example the registration arrangement employs a scuffing assembly 70, in other contemplated aspects the scuffing assembly 70 could be replaced by a tamper, the tamper being disposed on the compiling shelf 60, in opposition to the side plate 68.

A sensing mechanism 76, adapted to sense the height of the lower stacking tray 34, with or without sets of stapled copy sheets therein, is disposed below the compiling shelf 60. The sensing mechanism 76 includes an arm 77 and a switch 78. The arm 77 is pivotally connected to and in contact with the switch 78. The switch 78 is connected operatively to a bottom surface of the compiling shelf 60. The switch 78 is in communication with the controller 58. The arm 77 is constrained in a predetermined arc so that it is movable between a first position and a second position, the first position triggering an open switch position and the second position triggering a closed switch position.

In the illustrated embodiment of FIG. 1A, compiling shelf 60 is disposed in a copy sheet compiling position by a spring loaded reciprocal drive mechanism 80. The mechanism 80 includes a pivotable cam follower 82, the cam follower 82 being coupled to the back of compiling shelf 60 by a link assembly 84. The cam follower 82 is spring-loaded by use of a spring 88, and cam follower 82 is urged into the compiling position by use of a cam 90. The cam 90 is secured to a shaft 92, the shaft 92 being coupled to a motor 94. Control of motor 94, and hence rotation of shaft 92, is controlled by use of the controller 58. As should be clear to those skilled in the art, the shaft 92 is positioned off-center with respect to the perimeter of cam 90, so that cam follower 82, and hence compiling shelf 60 are reciprocated by simply rotating cam 90 with shaft 92. In the present example, the compiling shelf 60 is reciprocated by use of a camming arrangement, but in other contemplated embodiments reciprocation could be achieved through use of any known suitable arrangement, such as a rack and pinion mechanism.

Referring again to FIGS. 1A and 2, a mechanism for fastening sheets together, namely a conventional stapler, is designated by the numeral 96. The stapler is positioned, in the illustrated example, for corner-stapling of copy sheets. While, in the preferred embodiment, the stapler 96 is employed to secure copy sheets together, other suitable paper-securing mechanisms, such as gluers or binders could be employed to secure the copy sheets together. Additionally, it is contemplated that, when desired, more than one stapler 96 could be positioned adjacent the compiling shelf 60 to achieve multiple stapling of registered copy sheets. Finally, it should be appreciated that the compiling shelf or platform 60 should be dimensioned so that both scuffing and stapling are accomplished adequately. Regarding scuffing, registration cannot be achieved unless the copy sheets have an appropriate area across which to be shoved. Regarding stapling, when the set of copy sheets is positioned between the jaws of the stapler 96 and the platform 60, the area of the base or "anvil" should be sufficient to avoid skewing of the stapled set before or upon stapling.

Figure 1B:
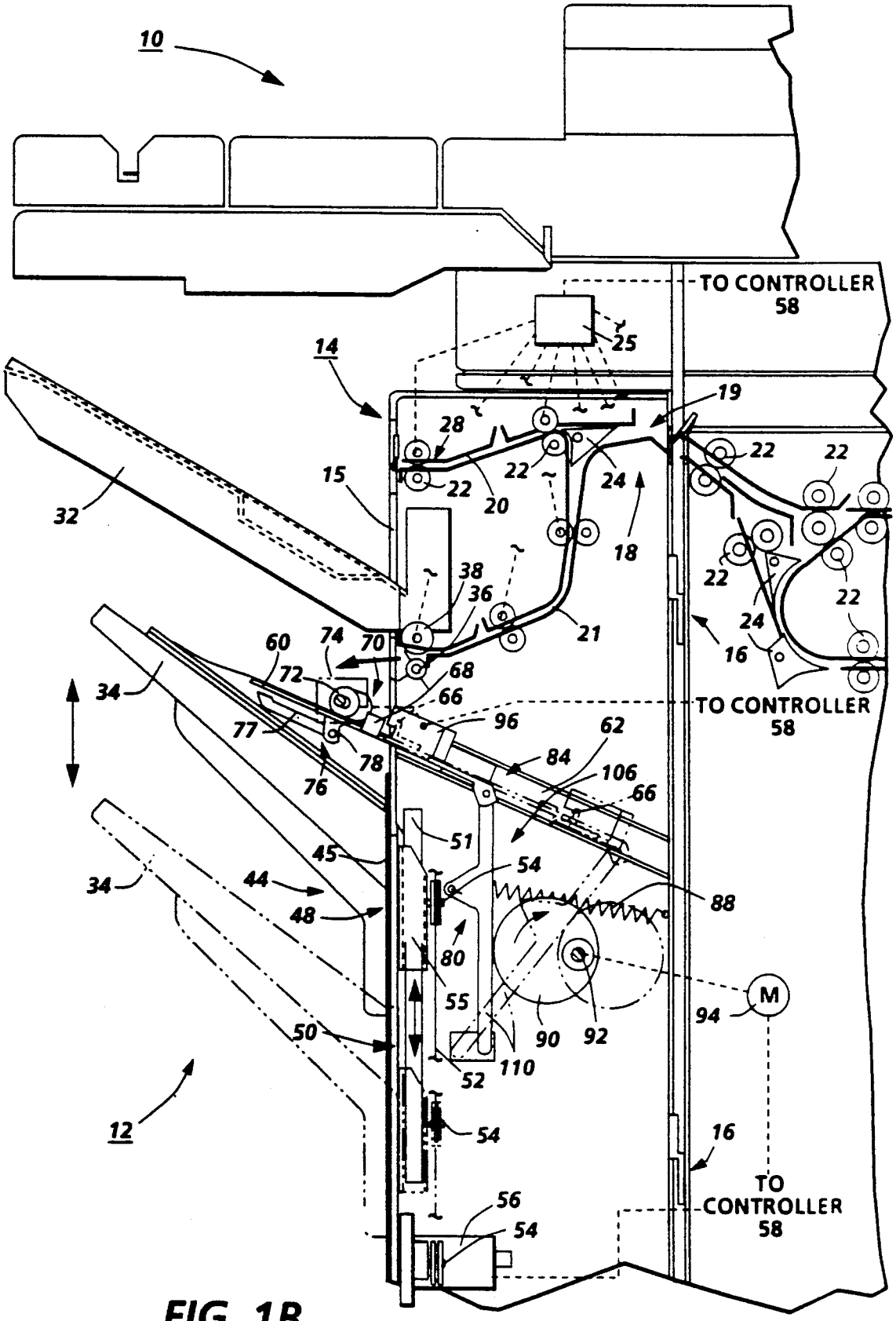
FIG. 1B is basically the same view as that illustrated in FIG. 1A, except that the stapler in FIG. 1B is mounted operatively in the movable compiling shelf.

Even though the stapler 96 in FIGS. 1A and 2 is shown mounted to the housing 15, in an alternative embodiment illustrated in FIG. 1B, the stapler 96 could be operatively mounted to a rearward portion of compiling shelf 60. In this alternative embodiment, the stapler 96 is reciprocated in unison with the compiling shelf 60. This would, of course, result in more moving mass. Moreover, in the alternative embodiment of FIG. 1B, the abutment tabs 66 are received by and aligned with the channels 70 so that, upon retracting the compiling shelf 60, the abutment tabs 66 pass freely through the channels 70. In either embodiment of FIG. 1A or FIG. 2, the stapler 96 is in communication with the controller 58.

Stapled sets of copy sheets can be pushed off the compiling shelf 60 by use of set pushing assembly 98. The pushing assembly 98 (FIG. 1-3A) includes two elongate fingers 100, each finger 100 having a front raised edge 104. A rearward portion of each elongate finger 100 is connected to a spring loaded drive mechanism 106, the structure of which mechanism 106 is very similar to that of drive mechanism 80. The mechanism 106 includes a cam follower 110, the cam follower 110 being urged into a retracted position by a spring loading mechanism 112. A cam 114 is secured to the shaft 92. The cam 114 is adapted to reciprocate the cam follower 110 in the same manner that cam 90 is adapted to reciprocate the cam follower 82. It should be appreciated that the cams 90, 114 are dimensioned so that the front edge of compiling shelf 60 can be retracted to the front edge of housing 15, and so that the front raised edge 104 of finger 100 can be "thrown" to the front edge of housing 15.

In operation, one or more copy sheets are transported by way of paper path 19 (FIG. 1A) to the deflector 24 disposed at the junction of paper paths 20, 21. To stack unstapled copy sheets, the deflector 24 at the junction is set, by use of drive 25 and controller 58, so that copy sheets are diverted into the upper paper path 36.

Referring to FIGS. 3A-3E, the operation of the finisher 12 is now explained in further detail. In the simplest case (FIGS. 3A-3D) there are no sets of stapled copy sheets in the lower stacking tray 34 so that as the first copy sheet is ejected from the output end of lower paper path 21 it lands on portions of both the lower stacking tray 34 and the compiling shelf 60. More specifically, a first portion of the copy sheet is positioned on the lower stacking tray 34 and a second portion of the copy sheet is positioned on a first portion of the compiling tray 60.

In response to gravity, the second portion of copy sheet falls and slides back towards the rearward or second portion of the compiling shelf 60 until it is aligned in the direction of sheet conveyance by one of the abutment tabs 66. In the meantime, the scuffing wheel 72 rotates in response to the motor 74 being energized by a signal from the controller 58. A corner of the incoming copy sheet is shoved, via scuffing of the wheel 72, into the corner defined by one of abutment tabs 66 and the side plate 68. Accordingly, edges of the copy sheet are aligned along the direction of sheet conveyance and the direction perpendicular to the direction of conveyance so that the copy sheet is registered.

Figure 3A:
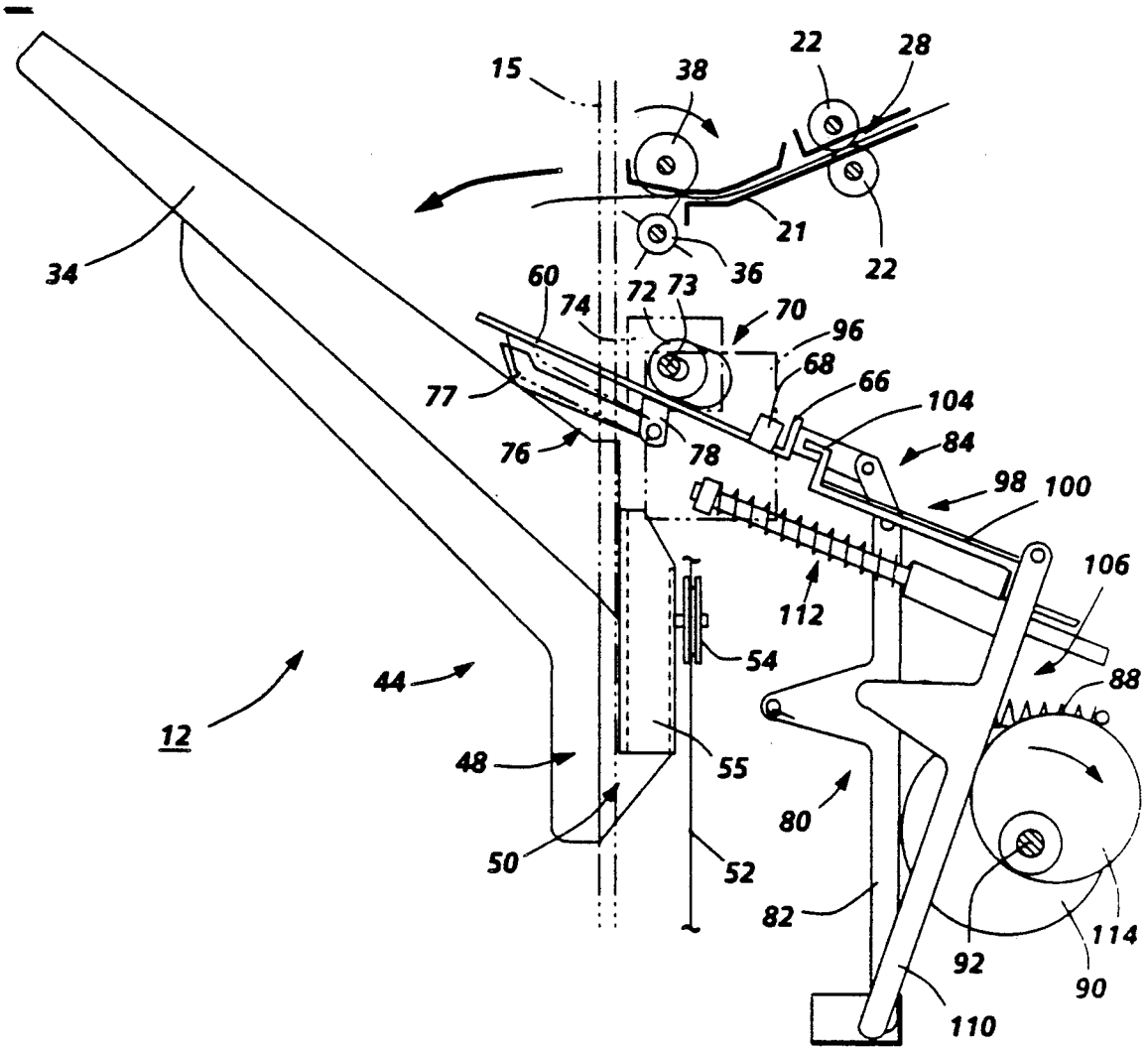
FIGS. 3A–3E are fragmentary, elevational views of the FIG. 1A finishing apparatus illustrating various aspects or steps of the operation of the finishing apparatus.
Figure 3B:
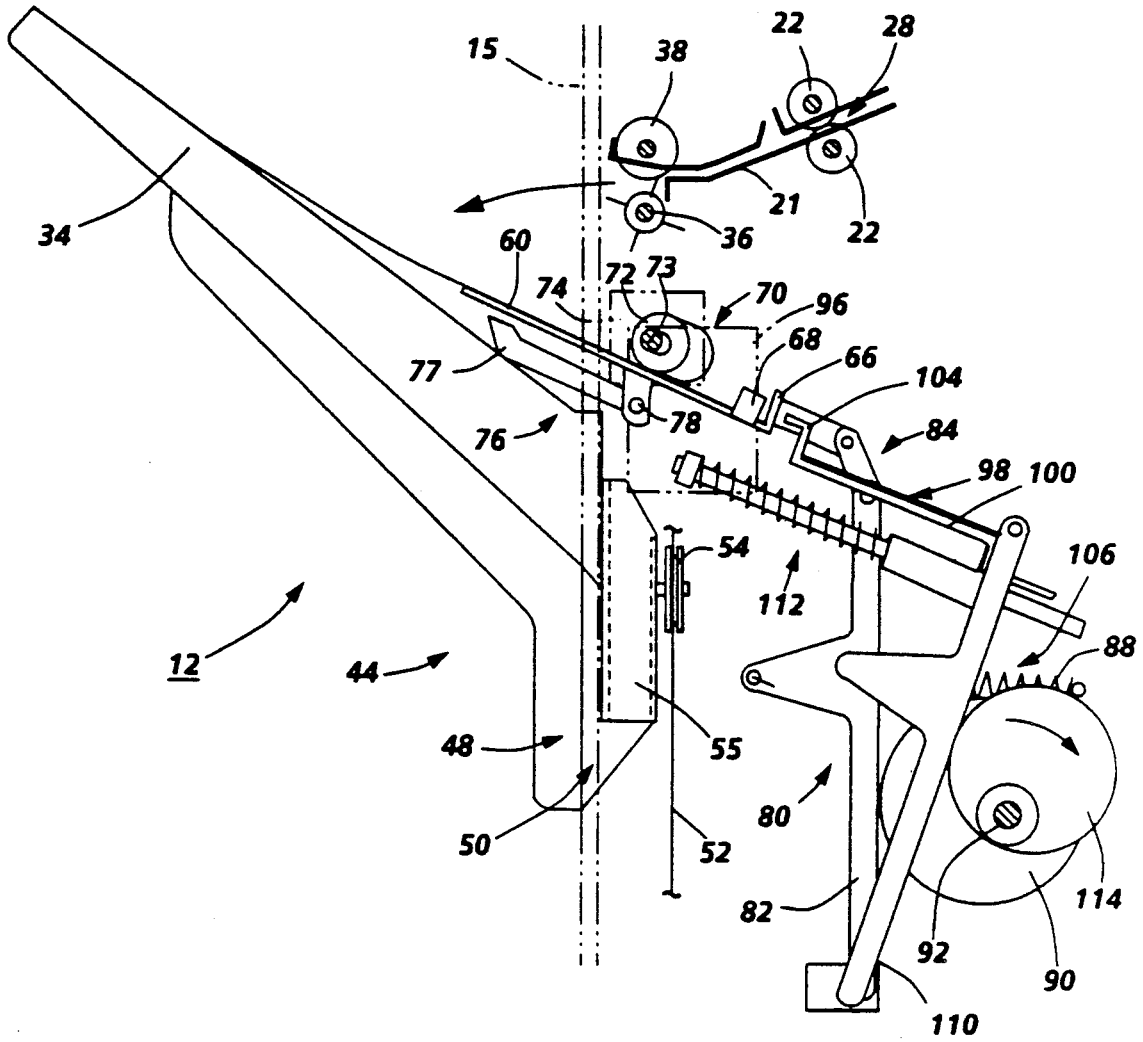
Figure 3C:
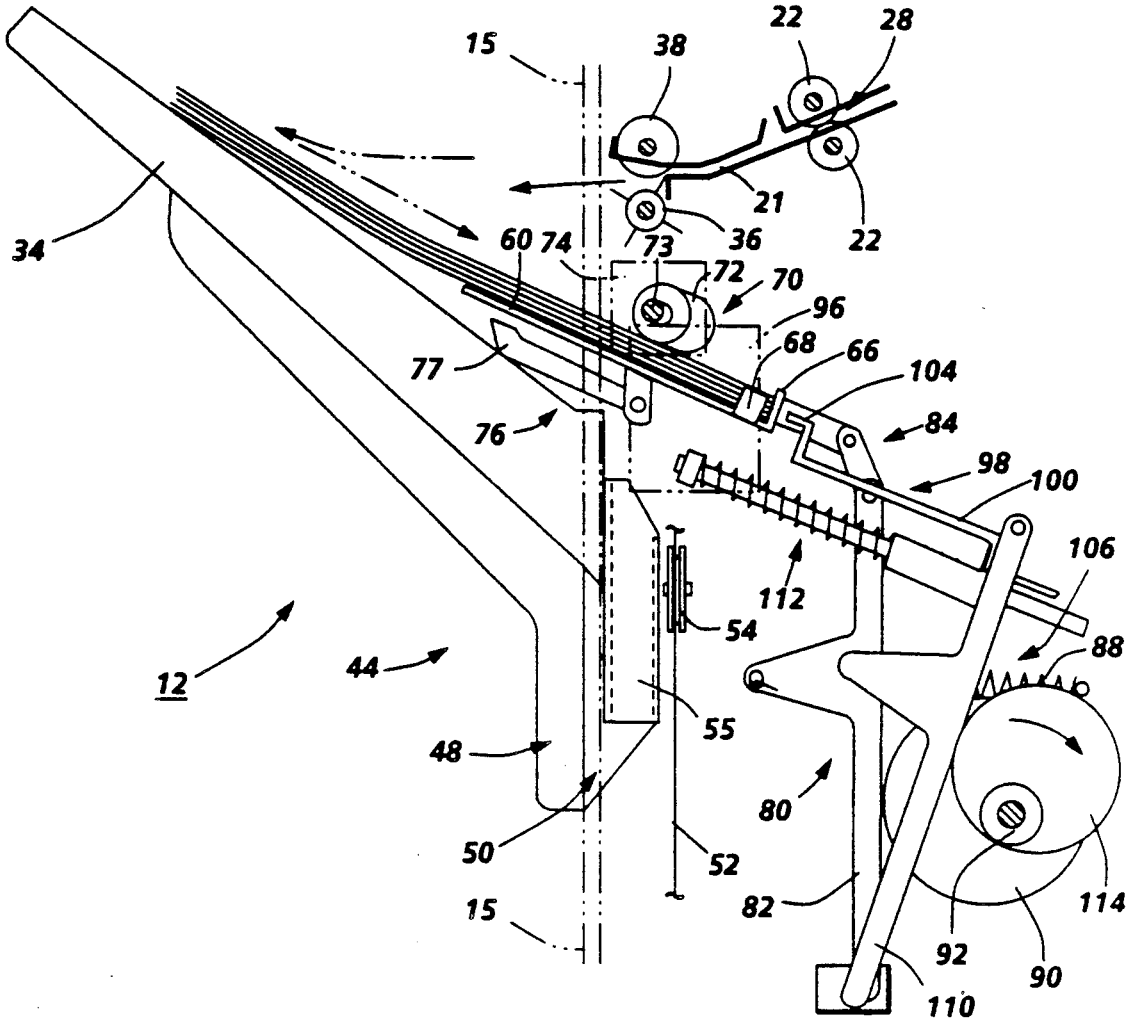

Referring to FIG. 3C, the above-described transporting/compiling procedure is followed sequentially for a plurality of incoming copy sheets so that each copy sheet is registered in the same manner as that described for the first copy sheet. Through use of the paddle wheel 36 in conjunction with the corrugated roller 38 the velocity at which each copy sheet exits the paper path 21 is regulated so that sheet scatter is minimized. Moreover, employment of the scuffing mechanism 70 allows for the registration of copy sheets having mixed sizes. After a predetermined number of copy sheets defining the desired finished set have been so compiled, the predetermined number being determined by the controller 58, a staple is driven through the corner of the registered set by the stapler 96 disposed in the registration corner.

Figure 3D:
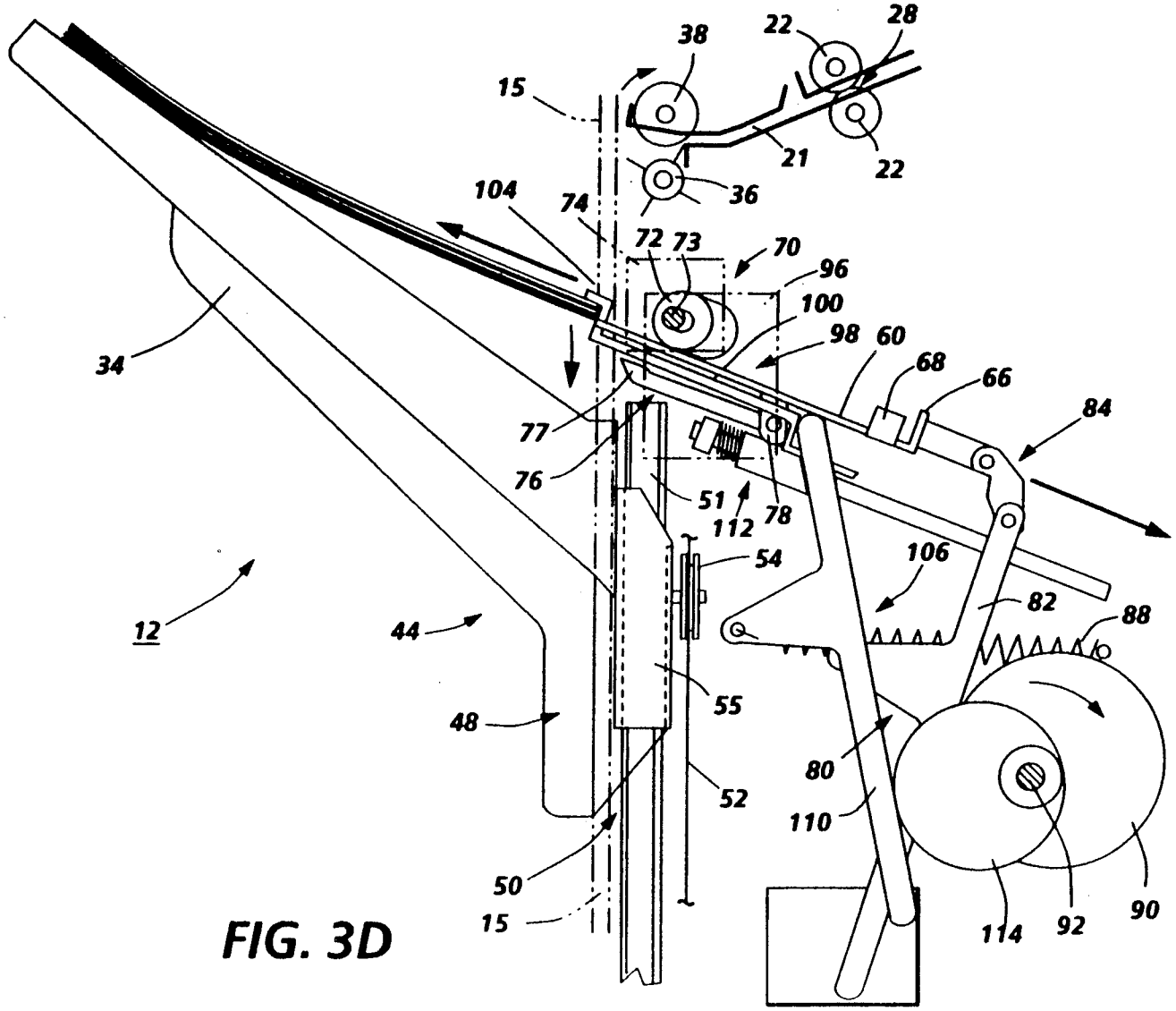

Referring to FIG. 3D, ejection of the stapled sets is achieved by energizing the motor 94, via controller 58, so that the fingers 100 are moved forward, through channels 69, by use of drive mechanism 106, and compiling shelf 60, is retracted by use of drive mechanism 80. As the fingers 100 are moved forward, the front raised edge 104 contacts the second portion of the stapled set and begins urging it toward the lower stacking tray 34, while the first portion of the compiling shelf 60 is being pulled out from underneath the second portions of the copy sheets. Additionally, it should be noted that the sensing mechanism 76 is retracted in unison with the compiling shelf 60. Accordingly, the sensing arm 77 pivots from the second position to the first position so that the switch 78 is disposed in the open position. When the trailing edge of the stapled set of copy sheets reaches the front edge of housing 15, the set falls into the lower stacking tray.

Figure 3E:
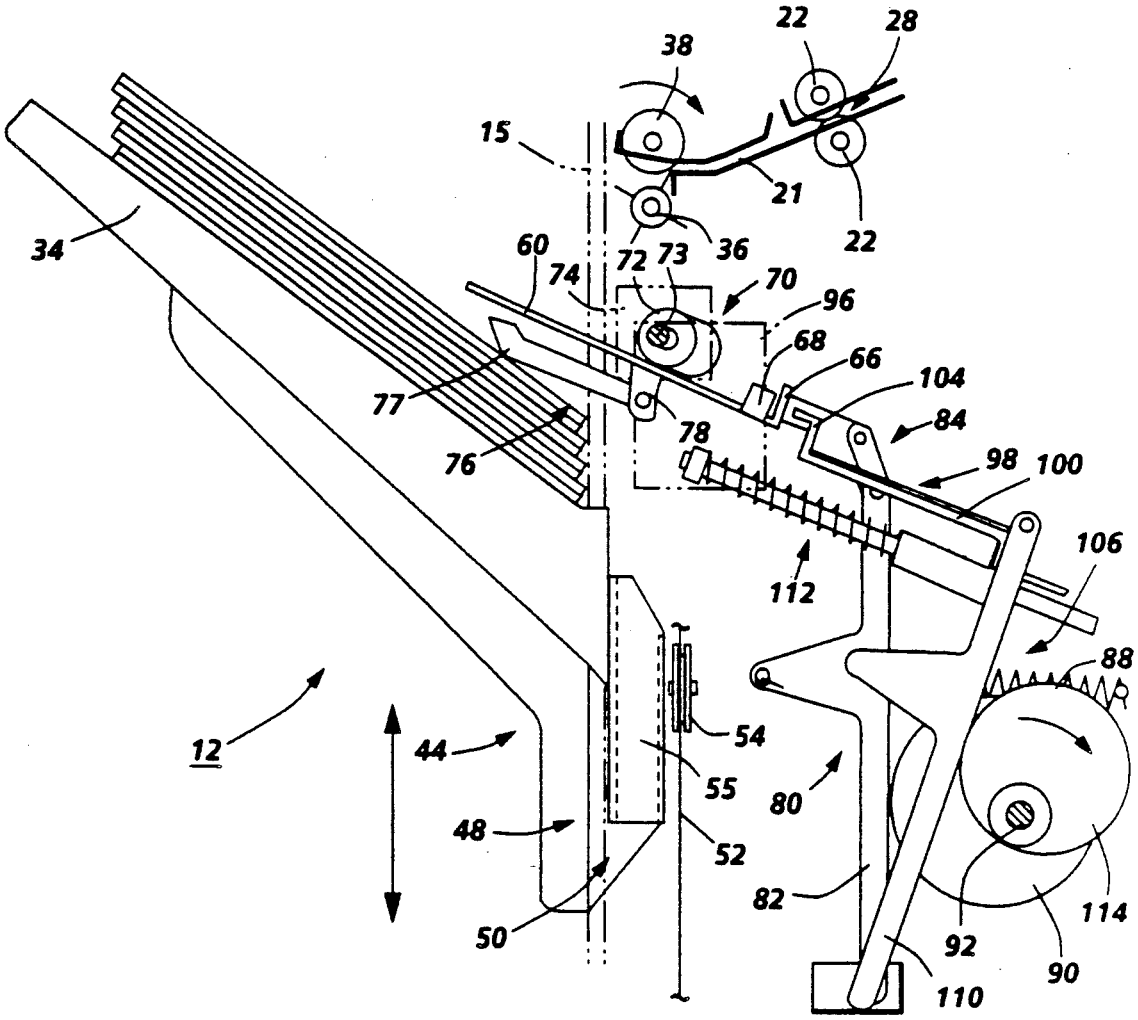

Referring to FIG. 3E, the use of finishing apparatus 12 to stack and compile multiple sets of stapled copy sheets is further explained. Prior to ejecting a stapled set from compiling shelf 60, the controller 58 receives a signal from a component of the finishing apparatus 12, such as the motor 94, and accordingly the controller 58 sends a signal to the elevator motor 56 to lower the elevator support 48 by a predetermined distance. The predetermined stacking tray lowering distance should be great enough so that the descent of the next stapled set is not impaired by the sets of stapled copy sheets already resting in the stacking tray 34.

As soon as a stapled set has been ejected, the compiling shelf 60 is returned to the compiling position. It should be recognized that the compiling shelf 60 returns to the compiling position as the cams 90, 114 are rotated through a predetermined arc by the shaft 92. As soon as the compiling shelf 60 is returned to the compiling position, the elevator support 48 begins to rise via the track 51. Before raising the stacking tray 34 to its stacking position, it is desirable to side-shift, i.e. laterally displace, side-shifting plate 45, and thus stacking tray 34, so that sets are off-set for ease of removal and not caught or stubbed as they are stacked in the stacking tray 34. Side-shifting is accomplished by moving the plate 45 on a track (not shown), the plate being driven on the track by way of a conventional motor (not shown). The elevator assembly 44 continues to rise, and the top of the stack on stacking tray 34 eventually contacts the sensing arm 77. The sensing arm 77 is then pivoted through the predetermined arc, and closes the switch 78. When the switch 78 is closed a corresponding signal is sent by the switch 78 to the controller 58. In turn, the controller 58 signals the elevator motor 56 to halt movement of the elevator support 48.

As will be appreciated by those skilled in the art, due to the relationship of the angles alpha and beta (FIG. 1A), the compiling shelf 60 does not stub on the sets in the stacking tray 34 when the switch 78 is finally closed. Additionally, the function of the sensing arm 77 and the switch 78 could be accomplished by mounting alternative conventional sensing devices, such as an optically-based sensor to the underside of the first portion of the compiling shelf 60. Finally, the timing required to raise and lower the elevator support, as well as to reciprocate both the compiling shelf 60 and the elongate finger 100, can be achieved readily by programming the controller 58 with appropriate software.

Referring still to FIG. 3D, it should be appreciated that the finishing apparatus 12 can be used as a high capacity stacker, and is particularly useful for stacking uncollated, unfastened sets of copy sheets. When using the finishing apparatus 12 as a high capacity stacker, copy sheets intended for delivery to the upper stacking tray 32 are diverted to the lower stacking tray 34 and the compiling shelf 60 by use of the diverter 24. After compilation, registered, uncollated sets of copy sheets are delivered across a relatively short ejection distance. Accordingly, a stack that is less prone to buckling is formed. Since the upper surface of the stack can be kept relatively flat, more accurate sensing of the resulting stack can be achieved. Moreover, since, during stacking, the sensing mechanism is retracted with the compiling shelf 60, the sensing arm 77 does not interfere with the stacking process.

Figure 4:
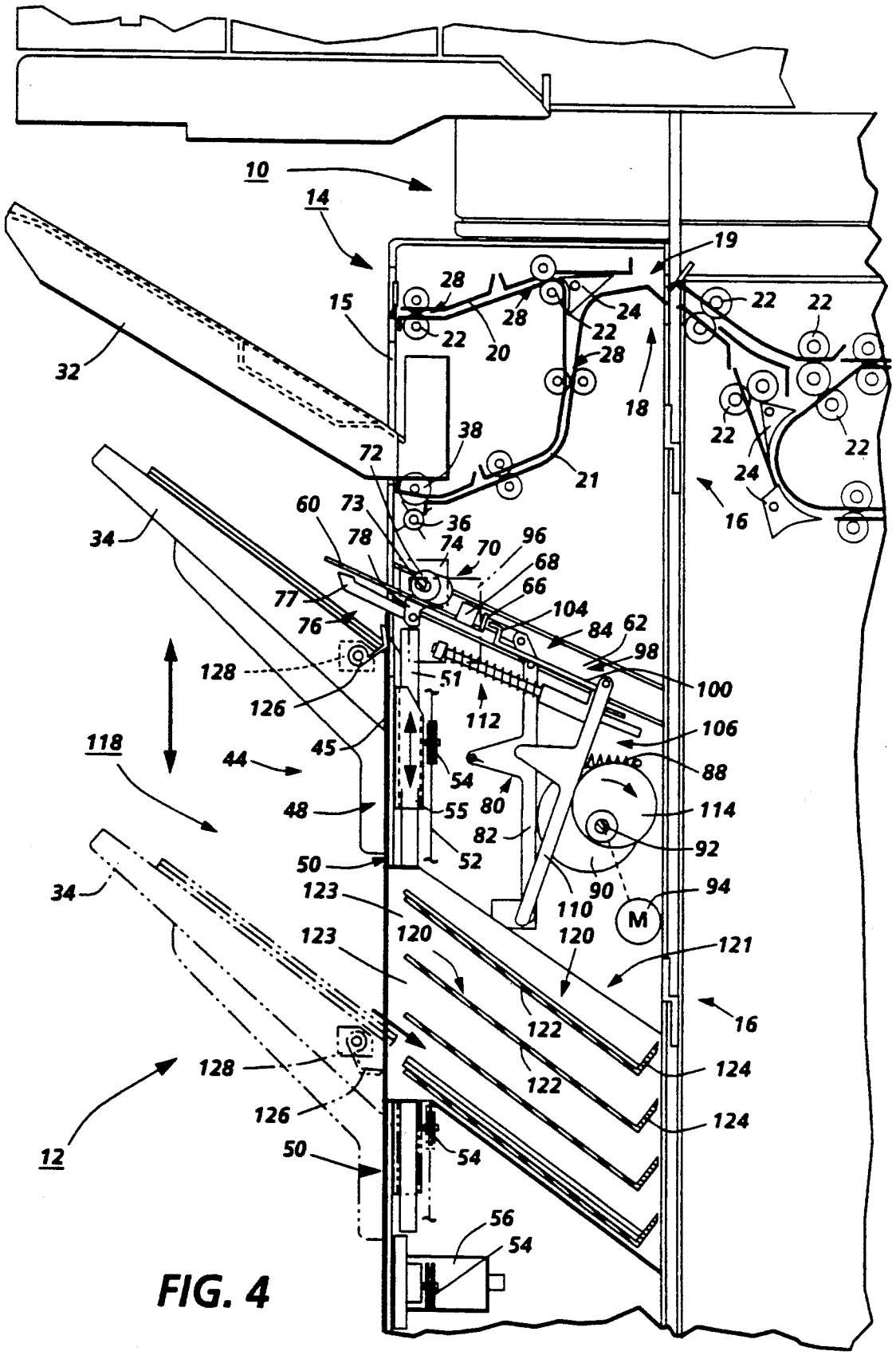
FIG. 4 is a schematic, fragmentary, elevational view of a "mail-boxing" arrangement employing the FIG. 1A finishing apparatus.

Referring to FIG. 4, an alternative, additional, mail boxing arrangement employing the finishing apparatus 12 is designated by the numeral 118. In the arrangement 118, a plurality of bins 120 are mounted in a bin housing 121, the bin housing 121 being disposed within the housing 15. The compiling shelf 60 and the bins 120 are disposed along a common plane. Each of the bins 120 includes a bin stacking tray 122 and an entrance opening 123. A back stop 124 is integrally formed along a rearward edge of each bin stacking tray 122. Additionally, each bin stacking tray 122 is positioned in a plane that is coplaner with the plane defined by stacking tray 34. A gate 126 is pivotally mounted to the stacking tray 34, the pivoting of gate 126 being implemented by a drive 128 and the controller 58.

In operation, a predetermined number of stapled sets are stacked in the lower stacking tray 34, and the gate 126 is closed. The stacking tray 34 is then lowered to a location adjacent to a preselected bin 120. In the simplest case, the bin 120 is initially empty, and the stacking tray 34 is positioned just above a surface of the bin tray 122. Positioning the stacking tray 34 just above the surface of the bin tray 122 allows the sets retained therein by gate 126 to slide freely into the preselected bin 120 without getting hung up at the entrance opening 123. When some sets are deposited initially in the bin 120, the stacking tray 34 is positioned just above the uppermost set of stapled copies. Positioning of the stacking tray 34 is accomplished by programming the controller 58 with appropriate software, the software being responsive to user input. Indeed, with certain printing apparatus 10, each set can be pre-indexed so that the controller 58 recognizes automatically the preselected bin 120 to which the indexed set is to be delivered. For example, when the printing apparatus 10 is a printer, each incoming job to the printer can be precoded, the code serving as the above-mentioned index.

As an alternative embodiment, it will be appreciated that although only one stacking tray 34 is shown, the stacking tray 34 could instead be one selected bin of a moving sorter with plural bins, as is well shown in the art, such as our U.S. Pat. No. 4,982,948, issued Jan. 8, 1991, or U.S. Pat. No. 4,925,171, or U.S. Pat. No. 4,678,179 and its cited art. In this alternative embodiment, the stack height arm would not necessarily be employed and the vertical distance between the output or nip of path 21 would be decreased. Use of the one preselected bin would allow advantageously for the collection of stapled sets of copy sheets and unstapled copy sheets in the same bin.

It should be evident that there has been provided, in accordance with the present invention, a single tray finishing apparatus that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A finishing apparatus adapted to receive and fasten collated sets of copy sheets, comprising:

means for stacking at least one set of fastened copy sheets;

a movable compiling member having a portion thereof disposed selectively over said stacking means;

means for transporting the copy sheets to both said stacking means and said movable compiling member and stacking the copy sheets as a set so as to position one portion of the copy sheet set in said stacking means with the remaining portion of the copy sheet set being located in said movable compiling member, wherein, as each copy sheet is stacked as a set, each copy sheet is simultaneously supported by both the portion of said compiling member and said stacking means;

means for fastening a set of copy sheets to one another, said fastening means being positioned adjacent to said compiling member; and means for retracting said portion of said movable compiling member supporting the copy sheets away from both the copy sheets and said stacking means after the copy sheets of the set of copy sheets have been fastened to one another so that the entire set of fastened copy sheets is supported in said stacking means.

2. The finishing apparatus of claim 1, further comprising elevator means for moving said stacking means to accommodate for changes in the height of the stack of sets collected in said stacking means.

3. The finishing apparatus of claim 1, wherein said fastening means comprises at least one stapler for driving a staple through the set of copy sheets during the fastening operation.

4. The finishing apparatus of claim 1, further comprising means for urging the set of copy sheets in a direction opposed to the direction in which said compiling member is retracted.

5. A finishing apparatus adapted to receive and fasten collated sets of copy sheets, comprising:

means for stacking at least one set of fastened copy sheets;

a movable compiling member having a portion thereof disposed selectively over said stacking means;

means for transporting the copy sheets to both said stacking means and said movable compiling member so as to position one portion of each copy sheet in said stacking means with the remaining portion of each copy sheet being located in said movable compiling member;

means for fastening a set of copy sheets to one another, said fastening means being positioned adjacent to said compiling member;

means for retracting said portion of said movable compiling member supporting the copy sheets away from both the copy sheets and said stacking means after the copy sheets of the set of copy sheets have been fastened to one another so that the entire set of fastened copy sheets is supported in said stacking means; and sensing means for sensing the height of the stack of sets collected in said stacking means, said sensing means being disposed remotely of said stacking means when said compiling means is retracted away from the copy sheets.

6. The finishing apparatus of claim 5, wherein said apparatus further comprises elevator means for moving said stacking means to accommodate for changes in the height of the stack of sets collected in said stacking means, and wherein said sensing means includes:

an arm having first and second ends, said first end of said arm being adapted to contact a stack of sets collected in said stacking means;

a switch being mounted to an underside of said compiling member, and said second end of said arm being pivotally mounted to said switch for closing said switch when said arm is rotated through a predetermined arc; and control means for setting the position of said elevator means, said control means being responsive to the pivoting of said arm whereby the position of said elevator, and hence the position of said stacking means, is set when said arm is rotated through said predetermined arc.

7. The finishing apparatus of claim 6, wherein said arm moves away from said stacking means, in unison with said compiling member, when said compiling member is retracted.

8. A finishing apparatus, adapted to receive and fasten collated sets of copy sheets, comprising:

means for stacking at least one set of fastened copy sheets;

a movable compiling member having a portion thereof disposed selectively over said stacking means;

means for transporting the copy sheets to both said stacking means and said movable compiling member so as to position one portion of each copy sheet in said stacking means with the remaining portion of each copy sheet being located in said movable compiling member;

means for fastening a set of copy sheets to one another, said fastening means being positioned adjacent to said compiling member, said fastening means comprising at least one stapler for driving a staple through the set of copy sheets during the fastening operation, and wherein said stapler is connected to said compiling member so that said stapler is capable of being retracted in unison with said movable member;

means for retracting said portion of said movable compiling member supporting the copy sheets away from both the copy sheets and said stacking means after the copy sheets of the set of copy sheets have been fastened to one another so that the entire set of fastened copy sheets is supported in said stacking means.

9. A finishing apparatus, adapted to receive and fasten collated sets of copy sheets, comprising:

means for stacking at least one set of fastened copy sheets;

a movable compiling member having a portion thereof disposed selectively over said stacking means;

means for transporting the copy sheets to both said stacking means and said movable compiling member so as to position one portion of each copy sheet in said stacking means with the remaining portion of each copy sheet being located in said movable compiling member;

means for fastening a set of copy sheets to one another, said fastening means being positioned adjacent to said compiling member, wherein said fastening means is positioned adjacent said movable compiling member in a fastening position;

means for retracting said portion of said movable compiling member supporting the copy sheets away from both the copy sheets and said stacking means after the copy sheets of the set of copy sheets have been fastened to one another so that the entire set of fastened copy sheets is supported in said stacking means; and means for registering the remaining portions of the copy sheets being located in said compiling member along at least one edge thereof to provide an aligned edge for the set within said fastening position of said fastening means whereby fastening of the set may be accomplished.

10. The finishing apparatus of claim 9 wherein said registration means includes:

at least one abutment member being integrally connected with and extending upwardly from a back edge of said compiling member, said abutment member being adapted to align each copy sheet in the direction of copy sheet conveyance;

a sidewall being adjacent to and extending upwardly from a side edge of said compiling member, said sidewall being adapted to align the copy sheets in a direction perpendicular to the direction of copy sheet conveyance;

said sidewall forming a registration corner with said back edge of said compiling member; and scuffing means for scuffing the copy sheets and urging coincidental corners of the copy sheets into said registration corner, said scuffing means being superposed with said compiling member whereby the remaining portions of the copy sheets being located in said compiling member are disposed intermediate of said scuffing means and said compiling member 11. A finishing apparatus, adapted to receive and fasten collated sets of copy sheets, comprising:

means for stacking at least one set of fastened copy sheets;

a movable compiling member having a portion thereof disposed selectively over said stacking means;

means for transporting the copy sheets to both said stacking means and said movable compiling member so as to position one portion of each copy sheet in said stacking means with the remaining portion of each copy sheet being located in said movable compiling member;

means for fastening a set of copy sheets to one another, said fastening means being positioned adjacent to said compiling member; and means for retracting said portion of said movable compiling member supporting the copy sheets away from both the copy sheets and said stacking means after the copy sheets of the set of copy sheets have been fastened to one another so that the entire set of fastened copy sheets is supported in said stacking means, wherein said retracting means includes means for translating reciprocally said compiling member.

12. A finishing apparatus, adapted to receive and fasten collated sets of copy sheets, comprising:

means for stacking at least one set of fastened copy sheets, wherein said stacking means is a slanted tray;

a movable compiling member having a portion thereof disposed selectively over said stacking means;

means for transporting the copy sheets to both said stacking means and said movable compiling member so as to position one portion of each copy sheet in said stacking means with the remaining portion of each copy sheet being located in said movable compiling member;

means for fastening a set of copy sheets to one another, said fastening means being positioned adjacent to said compiling member;

means for retracting said portion of said movable compiling member supporting the copy sheets away from both the copy sheets and said stacking means after the copy sheets of the set of copy sheets have been fastened to one another so that the entire set of fastened copy sheets is supported in said stacking means;

elevator means for moving said stacking means to accommodate for changes in the height of the stack of sets collected in said stacking means;

a gate pivotally mounted to said elevator means, said gate being capable of moving between an open position and a closed position, said gate retaining one or more fastened sets in said slanted tray when said gate is in said closed position, and said sets being capable of sliding off of said tray when said gate is in said open position;

a plurality of slanted bins, each of said bins having an entrance opening;

a track being disposed adjacent said compiling member and said bins, said track being adapted to carry said elevator means, and hence said slanted tray, therealong, said slanted tray being transported to and aligned with respective ones of said slanted bins; and wherein when said gate is in said closed position a stack of fastened sets can be transported on said slanted tray from said compiling member to one of said bins, and upon said aligning of said slanted tray with said entrance opening of one of said slanted bins, said gate is movable to said open position so that the stack of stapled sets can be slid into said one slanted bin.

13. In a finisher for providing stapling of sets of sequentially produced reproduction sheets of the type including a set compiler, a stapling system for stapling the compiled sets, and a stacking tray for stacking the stapled sets, the improvement comprising:

a reciprocally movable partial compiling shelf having first and second positions;

means for moving reciprocally said partial compiling shelf between said first and second positions;

said first position of said partial compiling shelf being a compiling and stapling position in which said compiling shelf partially extends out over said stacking tray in a position to accumulate and partially support sheets for compiling and stapling as a set while those sheets are also partially supported by said stacking tray; and said second position of said partial compiling shelf being a stapled set unloading position in which said partial compiling shelf is moved away from said stacking tray and the stapled set to allow the stapled set to drop fully onto said stacking tray.

14. The finisher of claim 13, wherein said partial compiling shelf reciprocal movement between said first and second positions is only a minor portion of the dimensions of said stacking tray and said stapled sets for allowing said movement to be rapid.

15. The finisher of claim 13, wherein said partial compiling shelf is at a fixed vertical location, and wherein said stacking tray includes means for vertically lowering said stacking tray in accordance with the stacking of stapled sets on said stacking tray.

16. The finisher of claim 15, wherein said means for vertically lowering said stacking tray in accordance with the stacking of stapled sets on said stacking tray includes stack height sensor means adapted to sense the height of the stapled sets on said stacking tray, said stack height sensor means being mounted under said partial compiling shelf and movable with said partial compiling shelf away from said stacking tray for protection by said partial compiling shelf.

17. The finisher of claim 13, further comprising set ejecting means for pushing a stapled set off said partial compiling shelf towards said stocking tray by a short distance.

18. The finisher of claim 13, wherein said stapling system is connected to said reciprocally movable partial compiling shelf so that said stapling system is capable of being moved in unison with said compiling shelf.

19. The finisher of claim 13, further comprising a plurality of mailbox bins adapted to receive fastened sets of copy sheets.

20. The finisher of claim 19, further comprising means for moving at least one said set of copy sheets into at least one selected said mailbox bin.

21. The finisher of claim 19, wherein said partial compiling shelf reciprocal movement between said first and second positions is only a minor portion of the dimensions of said stacking tray and said stapled copy sets.

22. The finisher of claim 19, further comprising set ejecting means for pushing a stapled copy set off said partial compiling shelf towards said stacking tray by a short distance.

23. The finisher of claim 19, wherein said stapling system is connected to said reciprocally movable partial compiling shelf so that said stapling system is capable of being moved in unison with said compiling shelf.

24. The finisher of claim 20, wherein said partial compiling shelf reciprocal movement between said first and second positions is only a minor portion of the dimensions of said stacking tray and said stapled copy sets.

25. The finisher of claim 20, further comprising set ejecting means for pushing a stapled copy set off said partial compiling shelf towards said stacking tray by a short distance.

26. The finisher of claim 20, wherein said stapling system is connected to said reciprocally movable partial compiling shelf so that said stapling system is capable of being moved in unison with said compiling shelf.

27. The finisher of claim 13, further comprising:

a plurality of additional stacking trays forming a plurality of mailbox bins; and means for vertically moving said mailbox bins relative to said reciprocally movable partial compiling shelf so that said compiling shelf can define said first and second positions with respect to any selected one of said mailbox bins.

28. The finisher of claim 27, wherein said partial compiling shelf reciprocal movement between said first and second positions is only a minor portion of the dimensions of said stacking tray and said stapled sets.

29. The finisher of claim 27, further comprising set ejecting means for pushing a stapled set off said partial compiling shelf by a short distance.

30. The finisher of claim 29, wherein said set ejecting means is operating in coordination with the movement between said first and second positions for assisting the dropping of said stapled set onto said stacking tray.

31. The finisher of claim 27, wherein said stapling system is connected to said reciprocally movable partial compiling shelf so that said stapling system is capable of being moved in unison with said compiling shelf.

32. A method for receiving and fastening sets of copy sheets with means for stacking at least one set of fastened copy sheets and a movable compiling member, said method comprising the steps of:

moving a portion of said movable compiling member selectively over said stacking means;

transporting the copy sheets to both said stacking means and said movable compiling member;

stacking the copy sheets as a set so as to position one portion of the copy sheet set in said stacking means with the remaining portion of the copy sheet set being located in said movable compiling member, wherein, as each copy sheet is stacked as a set, each copy sheet is simultaneously supported by both the portion of said compiling member and said stacking means;

fastening a set of copy sheets to one another; and retracting said portion of said movable compiling member supporting the copy sheets away from both the copy sheets and said stacking means after the copy sheets of the set of copy sheets have been fastened to one another so that the entire set of copy sheets is supported on said stacking means.

33. The method of claim 32, further comprising the step of moving said stacking means to accommodate for changes in the height of the stack of fastened sets collected in said stacking means.

34. The method of claim 32, further comprising the step of urging the set of copy sheets in a direction opposed to the direction in which said compiling member is retracted.

35. The method of claim 32, further comprising the step of registering the remaining portions of the copy sheets being located in said compiling member along at least one edge thereof to provide an aligned edge for the set whereby fastening of the set may be accomplished.

36. A method for receiving and fastening sets of copy sheets with means for stacking at least one set of fastened copy sheets and a movable compiling member, said method comprising the steps of:

moving a portion of said movable compiling member selectively over said stacking means;

transporting the copy sheets to both said stacking means and said movable compiling member so as to position one portion of each copy sheet in said stacking means with the remaining portion of each copy sheet being located in said movable compiling member;

fastening a set of copy sheets to one another;

retracting said portion of said movable compiling member supporting the copy sheets away from both the copy sheets and said stacking means after the copy sheets of the set of copy sheets have been fastened to one another so that the entire set of copy sheets is supported on said stacking means;

providing means for sensing the height of the stack of fastened sets collected in said stacking means;

sensing the height of the stack using said sensing means; and remotely disposing said sensing means relative to said stacking means when said compiling member is retracted.

37. A method for receiving and fastening sets of copy sheets with means for stacking at least one set of fastened copy sheets and a movable compiling member, said method comprising the steps of:

moving a portion of said movable compiling member selectively over said stacking means, transporting the copy sheets to both said stacking means and said movable compiling member so as to position one portion of each copy sheet in said stacking means with the remaining portion of each copy sheet being located in said movable compiling member;

fastening a set of copy sheets to one another; and retracting said portion of said movable compiling member supporting the copy sheets away from both the copy sheets and said stacking means after the copy sheets of the set of copy sheets have been fastened to one another so that the entire set of copy sheets is supported on said stacking means, wherein the step of retracting said first portion of said compiling member includes reciprocally translating said compiling member.

38. A finishing apparatus adapted to automatically compile, fasten, and stack in fastened sets copy sheets being sequentially outputted by a printing apparatus, comprising:

a reciprocally movable partial compiling shelf having first and second positions;

means for reciprocally moving said partial compiling shelf between said first and second positions;

a plurality of stacking trays for stacking at least one fastened set in each tray;

said first position of said partial compiling shelf being a compiling and fastening position in which said compiling shelf partially extends out over one said stacking tray in a position to accumulate and partially support sheets for compiling and fastening as a set while those same sheets are also partially supported by said one stacking tray;

fastening means for fastening said compiled set while it is in said first position to produce a said fastened set;

said second position of said partial compiling shelf being a fastened set unloading position in which said partial compiling shelf is moved away from said one stacking tray and said fastened set is allowed to drop fully onto said one stacking tray; and tray selecting means for moving at least one of said stacking trays relative to said partial compiling shelf so that a selected stacking tray can be operatively positioned in association with said compiling shelf for said compiling and fastening, and said fastened set unloading.

39. The finisher of claim 38, wherein said partial compiling shelf reciprocal movement between said first and second positions is only a minor portion of the dimensions of said one stacking tray and said stapled copy sets.

40. The finisher of claim 38, further comprising set ejecting means for pushing a stapled copy set off said partial compiling shelf towards said one stacking tray by a short distance.

41. The finisher of claim 38, wherein said fastening means comprises a stapling system for driving a staple through said compiled set during the compiling and fastening operation.

42. The finisher of claim 38, wherein said fastening means is connected to said reciprocally movable partial compiling shelf so that said fastening means is capable of being moved in unison with said compiling shelf.

* * * * *